United States Patent [19]

Cornell et al.

[11] 4,347,968

[45] * Sep. 7, 1982

[54] STACKABLE CARTON FOR PERISHABLE COMMODITIES

[75] Inventors: William F. Cornell, Fresno; John P. Vear, Salinas, both of Calif.; E. Anthony Pascuzzi, Arden Hills, Minn.

[73] Assignee: Champion International Corporation, Stamford, Conn.

[ * ] Notice: The portion of the term of this patent subsequent to Nov. 27, 1996, has been disclaimed.

[21] Appl. No.: 238,659

[22] Filed: Feb. 26, 1981

Related U.S. Application Data

[63] Continuation-in-part of Ser. No. 89,885, Oct. 31, 1979, abandoned, which is a continuation-in-part of Ser. No. 936,612, Aug. 24, 1978, Pat. No. 4,175,692.

[51] Int. Cl.[3] ..... B65D 13/00; B65D 5/32

[52] U.S. Cl. ..... 229/33; 229/36; 229/23 R

[58] Field of Search ..... 229/6 R, 6 A, 23 R, 229/36, 30, 31 R, 31 FS, 32, 33, 34 R, 34 A, 43

[56] References Cited

U.S. PATENT DOCUMENTS

| | | | |
|---|---|---|---|
| 2,797,854 | 7/1957 | Myers | 229/34 R |
| 2,846,133 | 8/1958 | Burden | 229/34 R |
| 2,893,621 | 7/1959 | Harnich | 229/34 R |
| 3,373,921 | 3/1968 | Crane | 229/34 R |
| 3,820,706 | 6/1974 | Gileson | 229/31 FS |
| 3,937,390 | 2/1976 | Winkler | 229/23 R |
| 3,998,379 | 12/1976 | Myers | 229/23 R |
| 4,103,819 | 8/1978 | Muise | 229/6 A |
| 4,134,533 | 1/1979 | Heanner | 229/34 R |

*Primary Examiner*—Herbert F. Ross

*Attorney, Agent, or Firm*—Evelyn M. Sommer; John H. Mulholland

[57] ABSTRACT

A blank and a stackable carton produced from the blank and particularly suited for packing fresh fruits and vegetables includes a tray with a rectangular floor panel and vertical side walls. The side walls includes side cover flaps extending from fold lines defining the outer edges of the side walls. Pairs of side wall flaps are provided, each flap in each pair extending from a fold line defining an end of the side walls. A generally rectangular stacking panel is fitted into each end of the tray. Each stacking panel may include a pair of recesses at its lower edge which are aligned with openings in the rectangular floor panel of the tray. The trays can be vertically stacked with the openings in the floor of one tray aligned with tabs protruding from the upper surface of the lower tray.

12 Claims, 11 Drawing Figures

FIG. 6
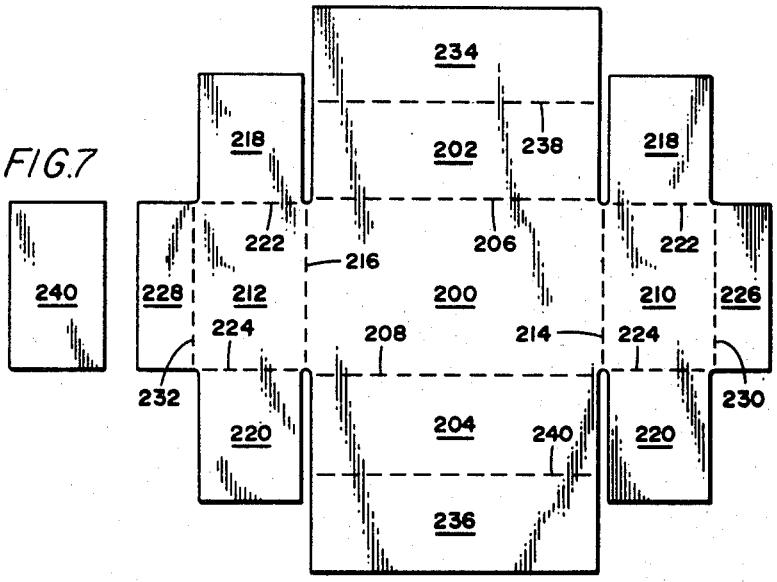
FIG. 7
FIG. 7A
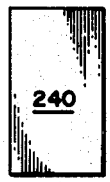
FIG. 8
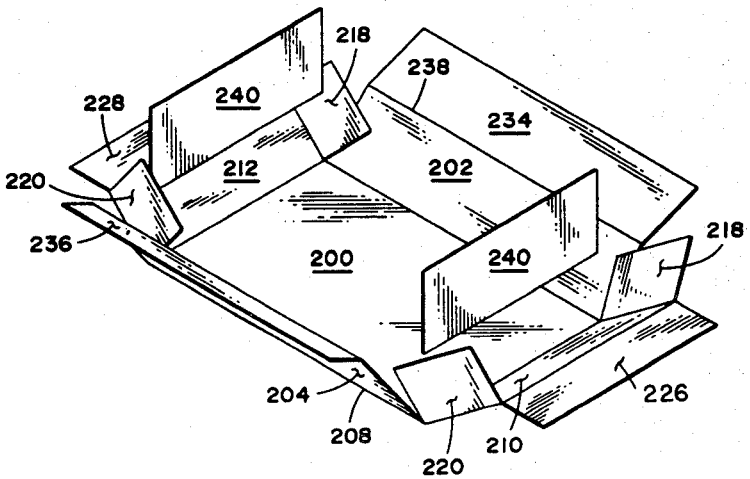

STACKABLE CARTON FOR PERISHABLE COMMODITIES

This application is a continuation-in-part of Ser. No. 89,885 for "STACKABLE CARTON FOR PERISHABLE COMMODITIES," filed Oct. 31, 1979, now abandoned by William F. Cornell, John P. Vear and E. Anthony Pascuzzi, which in turn, is a continuation-in-part of U.S. Pat. application Ser. No. 936,612, filed Aug. 24, 1978, now U.S. Pat. No. 4,175,692 for "STACKABLE CARTON FOR PERISHABLE COMMODITIES," by the same inventors and assigned to the same assignee.

The present invention relates to carton blanks and to stackable cartons formed therefrom. The cartons are particularly suitable for holding perishable commodities.

Growers of fruits and vegetables have traditionally used wooden boxes for storage and shipment of their products. Wooden boxes can be reaidly packed either in the field or at packing sheds and stand up well during short term or long term storage.

Wooden boxes suffer from the disadvantage however they are somewhat expensive to make because of the cost of raw materials and of labor in making such boxes. Also, wooden boxes must be manufactured in their erected form and shipped fully erected to the grower. Since the boxes are bulky even when empty, the costs of shipping them to the user in quantity are high.

Paper materials, such as corrugated, are less expensive than wood and can be readily formed into erected cartons which can be shipped to a user in a collapsed condition to save freight costs. However, corrugated cartons have not been widely accepted by growers of fruit and vegetables because of concerns that such cartons may be more easily degraded by moisture than wooden boxes and because it is thought that cardboard cartons do not stack as well as wooden boxes of the same size.

The present invention is concerned with the problem of providing carton blanks and cartons erected therefrom which (a) may suitably be treated; i.e., with wax, to inhibit degradation under moisture conditions and (b) which may readily be shipped in collapsed state and erected on site for loading with perishable commodities and thereafter stacked.

With the foregoing in mind we provide in accordance with the invention a blank which may be erected into a stackable storage and shipping tray after a single pass through an adhesive applicator device and for use in combination with generally rectangular shaped stacking panels wherein the erected tray includes opposed triple-ply adhesively connected end wall assemblies, said blank being characterized by a generally rectangular floor panel (4), first and second generally rectangular side wall panels extending from fold lines defining opposite edges of said floor panel, first and second generally rectangular side cover flaps extending from fold lines defining the outer edges of said first and second side wall panels, respectively, first and second pairs of side wall flaps, each flap in each of said pairs extending from a fold line defining an end of one of said side wall panels, each of said side wall flaps including at least one tab extending upwardly from an upper edge thereof and at least one recess at its lower edge in vertical alignment with said tab, first and second generally rectangular end wall panels extending from opposite end edges of said floor panel, each of said end wall panels having first and second recesses at its lower edge, said floor panel end edges having openings therein, said end wall panel recesses and said floor panel end edge openings being in vertical alignment when said blank is folded to form said tray.

We also provide in accordance with the invention a stackable storage and shipping tray which is characterized by comprising a generally rectangular floor panel, first and second side wall panels extending generally upright from opposite edges of said floor panel, each of said side wall panels including side wall flaps extending from opposite ends thereof and a side cover flap extending from the free side thereof, each said side cover flap including recesses adjacent its side edges, each said side wall flap including at least one tab extending upwardly from an upper edge thereof and at least one recess at its lower edge in vertical alignment with said tab, first and second end wall panels extending generally upright from the remaining opposite edges of said rectangular floor panel, each said end wall panel having first and second recesses at its lower edge and being adhesively connected to the outer surface of the associated side wall flaps of said side walls, said first and second recesses being aligned with the recess in each of said side wall flaps, and first and second generally rectangular stacking panels with the outer surface of each stacking panel being adhesively connected to the inner surface of the associated side wall flaps of said side wall, said end wall panels, side wall flaps and stacking panels forming tripleply adhesively connected end wall assemblies wherein each tab on a side wall flap extends through a recess in one of said side cover flaps.

Further objects and advantages of the invention will become apparent from the following disclosure taken in conjunction with the accompanying drawings, in which:

FIG. 6 is a plan view of a carton blank which may be used to form a carton of an alternate embodiment having a double thickness on both the side walls and the end walls;

FIG. 7 is a plan view of a stacking panel blank used with the embodiment of FIG. 6; and FIG. 7A is a view similar to FIG. 7;

FIG. 8 is a perspective view of a carton partially erected from the blanks of FIGS. 6, 7;

As above noted, paperboard that has been wax-saturated is very expensive and there is a great deal of wood particle board available which is less costly than is saturated paperboard. We have found it advantageous with our blank to use a particle board stacking or end panel to strengthen the erected blank. Also, we modify the side wall flaps as hereinafter more fully described to accommodate the stacking panels.

Figure 1:
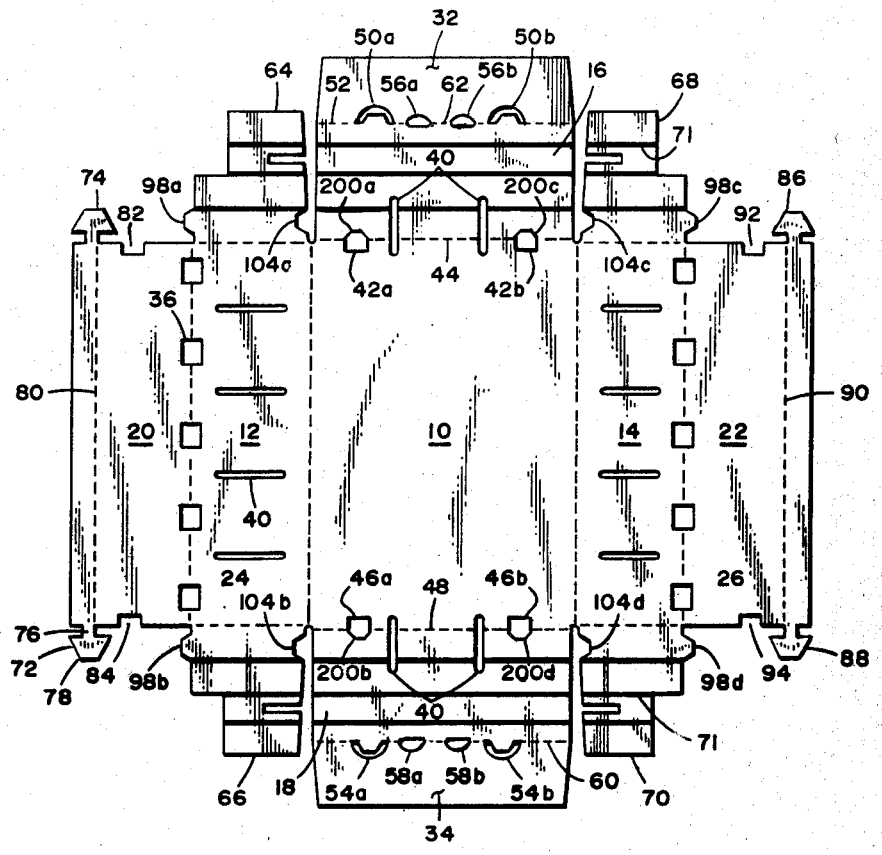
FIG. 1 is a plan view of a carton blank the stacking tabs of which are formed as a part of the carton blank.

More particularly and referring to FIG. 1, the carton blank has a rectangular floor panel 10 and upright side wall panels 12 and 14. The remaining two sides of the blank are formed by end wall panels 16 and 18. Side cover flaps 20 and 22 extend from fold lines 24 and 26 defining, when the blank is erected, the upper edge of the side wall panels 12 and 14, respectively. Each of the end wall panels 16 and 18 carries an end cover flap 32 and 34, respectively.

The carton is ventilated by a series of openings, such as opening 36, along the upper edge of each side wall panel and by spaced vertical slots, such as slot 40, in the body of each side wall panel.

The rectangular floor panel 10 has a first pair of openings 42*a* and 42*b* adjacent a fold line 44 defining one end of the panel 10. Similarly rectangular openings 46*a* and 46*b* are formed through panel 10 at the opposite end edge 48. Elongated openings 50*a* and 50*b* exist in end cover flap 32 at a fold line 52. A similar pair of elongated openings 54*a* and 54*b* exist in the opposite end cover flap 34. In the erected carton, each of those elongated openings is vertically aligned with a corresponding one of the openings in the floor panel 10.

Smaller elongated openings 56*a* and 56*b* are formed along fold line 52 while similar openings 58*a* and 58*b* are formed along the fold line 60 dividing end cover flap 34 from end wall panel 18. The carton material is slit at the inner end of each of the small elongated openings. For example, a short slit 62 extends parallel to the fold line 52 from elongated opening 56*a*. In the erected carton, the openings 56*a*, 56*b*, 58*a* and 58*b* are used in conjunction with locking tabs (to be described) in order to hold the side cover flaps 20 and 22 or cover panel means in their closed positions parallel to the floor panel 10.

Side wall flaps 64 and 66 extend from the upper and lower edges, respectively, of the side wall panel 12. Substantially identical side wall flaps 68 and 70 extend from the upper and lower edges, respectively, of the opposite side wall panel 14.

End wall panels 16 and 18 and side wall flaps 64, 66, 68 and 70 are covered with several strips 71 of a suitable adhesive, which can be applied in a single pass through a conventional adhesive applicator device. Such a device may be located at the blank manufacturing facility but is preferably located at or near the growers' locations to allow the cartons to be shipped and stored flat until they are to be used.

Each of the side cover flaps 20 and 22 includes a pair of locking tabs. More specifically, side cover flap 20 includes generally tapered locking tabs 72 and 74 at its opposite ends. The tapered base or straight side of each locking tab is parallel to the adjacent edge of the side cover flap. Referring specifically to locking tab 72, a material bridge 76 connects the tapered body 78 of the tab to the side cover flap. The side cover flap 20 includes generally rectangular notches 82 and 84 at its upper and lower edges, respectively.

The side cover flap 22 is a mirror image of side cover flap 20 including first and second locking tabs 86 and 88 and generally rectangular notches 92 and 94 at the upper and lower edges, respectively. The carton described thus far is used in combination with generally rectangular particle board stacking or end panels 96, a preferred embodiment of one such panel being shown in FIG. 2.

As will be seen in FIG. 1, each of side wall flaps 64, 66, 68, and 70 has formed therein a trapezoidal shaped tab 98*a*, 98*b*, 98*c*, and 98*d*, respectively, and recesses 104*a*, 104*b*, 104*c* and 104*d* respectively. When the carton is erected, side wall flaps 64, 66, 68 and 70 are bent upwardly relative to the side wall panels 12 and 14 and side wall panels 12 and 14 are then pivoted about the fold lines defining their boundaries with floor panel 10 to bring the side walls 12 and 14 into a generally upright position. End wall panels 16 and 18 are folded upright bringing their adhesive-coated areas into contact with uncoated surfaces of the side wall flaps 64 and 68 at one end and flaps 66 and 70 at the other end. The four side walls of the tray are secured in their upright positions by the adhering surfaces of the end wall panels and side wall flaps. In such erected condition, the outer face of the side wall flaps 64 and 68 is adhesively secured to the inner face of end wall panel 16 while the outer face of side wall flaps 66 and 70 is adhesively secured to the inner face of end wall panel 18. In such position, recesses 104*a*, 104*b*, 104*c* and 104*d* are located above and superimposed over recesses 42*a*, 46*a*, 42*b* and 46*b*, respectively in rectangular floor panel 10. They are also superimposed over and are congruent with trapezoidal shaped recesses 200*a*, 200*b*, 200*c* and 200*d*, respectively, formed in the base of end wall panels 16 and 18. Thus, when the erected carton is stacked on top of a second carton, the trapezoidal tabs 98*a*, 98*b*, 98*c*, and 98*d* of the bottom or second carton extend upwardly through recesses 42*a*, 46*a*, 42*b*, and 46*b* of the top carton to recesses 104*a* and 200*a*, 104*b* and 200*b*, 104*c* and 200*c*, and 104*d* and 200*d*, respectively to secure the cartons together.

Figure 2:
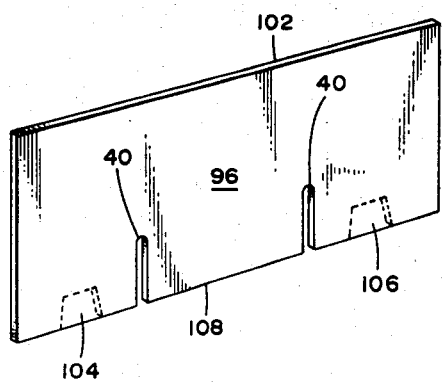
FIG. 2 is a perspective view of a stacking panel used with the carton formed from the blank of FIG. 1.

It will be understood that to further strengthen the end walls of said carton, the particle board end panel 96 shown in FIG. 2, may be utilized by adhesively attaching it to the inside of side wall flap pair 64 and 68 and pair 66 and 70. Since the trapezoidal stacking tabs are integrally formed with the carton blank as shown in FIG. 1, they need not be provided in the top 102 of end panel 96. Further, if desired, trapezoidal recesses 104 and 106 may be added to particle board end panel 96 at the bottom 108 as shown in dashed lines in FIG. 2 if desired to facilitate stacking although it is not necessary because such recesses 104*a*, 104*b*, 104*c* and 104*d* are already formed in side wall flaps 64, 66, 68 and 70 and end wall flaps 16 and 18. Because wax impregnated paper board is so expensive, particle board may be used to form the particle board end panel 96 and thus not only preserve the strength of the carton end walls but also provide for a carton that is more economically constructed.

If desired, ventilating slots 40 may be added to side wall flaps 64, 66, 68 and 70, end wall panels 16 and 18, and particle board end panel 96 such that corresponding slots are in superimposed relationship when the carton is erected.

When erected to the point described, the carton is ready to be packed with fruits, vegetables or other perishable commodities. After packing has been completed, the end cover flaps 32 and 34 are bent inwardly until generally parallel to the floor panel 10.

The locking tabs 72, 74, 86 and 88 are bent to right angles relative to the surfaces of side cover flaps 20 and 22. The side cover flaps 20 and 22 are then folded about the fold lines 24 and 26 to bring the downwardlyextending locking tabs 72, 74, 86 and 88 toward the small corresponding elongated openings 56*a*, 56*b*, 58*a* and 58*b* at the upper edges of the carton end walls 16 and 18. The locking tabs can be maneuvered through the small elongated openings to lock the side cover flaps in a closed position parallel to the floor panel 10.

The tapered locking tab 88 is bent at right angles to the major surface of side cover flap 22. The tapered tab 88 can be inserted into the small elongated opening 58*b* in end cover flap 34. A slit 114 at the inner edge of rectangular opening 58*b* may be provided to allow the flap material to deform sufficiently to pass tapered locking tab 88.

Cartons of the type described may be stacked as previously described.

The blank and carton described in the foregoing material is particularly suitable for use in field packing operations since a field worker can pack and close the carton without the use of machinery. The closed cartons can be stacked on the truck or wagon used to haul them from the fields.

Figure 4:
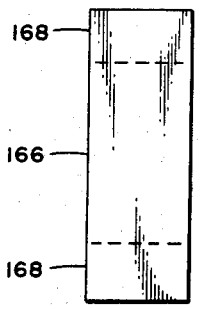
FIG. 4 is a plan view of a stacking panel which may be used with the blank of FIG. 3 to form side walls of double thickness.
Figure 3:
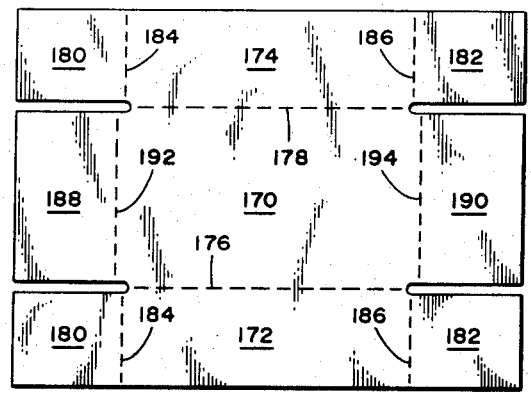
FIG. 3 is a plan view of a blank which may be used to form another embodiment carton having partial double thickness on the side walls and triple thickness on the end walls.
Figure 4A:
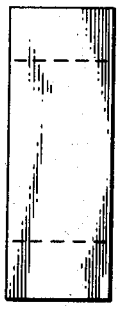
FIG. 4A is a view similar to FIG. 4.

FIG. 3 is a plan view of a blank which may be erected into an alternate embodiment of a stackable storage and shipping tray for use in combination with stacking panels shown in FIG. 4, which stacking panels 166 have flanges 168 integrally formed with and extending from opposite ends thereof by means of score lines wherein the erected tray includes opposed triple-ply adhesively connected end wall assemblies and opposed double-ply adhesively connected side wall assemblies. In FIG. 2, the blank has a generally rectangular floor panel 170, first and second generally rectangular side wall panels 172 and 174 extending from respective fold lines 176 and 178 which define opposite side edges of said floor panel 170, first and second side wall flaps 180 and 182 integrally formed with and extending from opposite ends 184 and 186 of said side wall panels 172 and 174 and first and second generally rectangular end wall panels 188 and 190 extending from opposite end edges 192 and 194, respectively of said floor panel 170.

Figure 5:
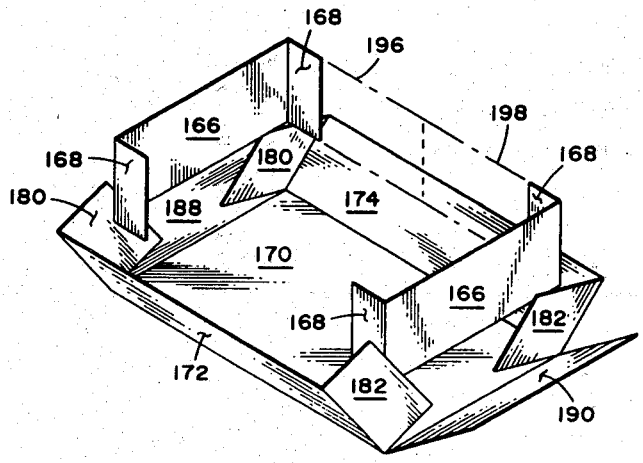
FIG. 5 is a perspective view of a carton partially erected from the blank of the embodiment illustrated in FIGS. 3, 4 and 4A.
Figure 9:
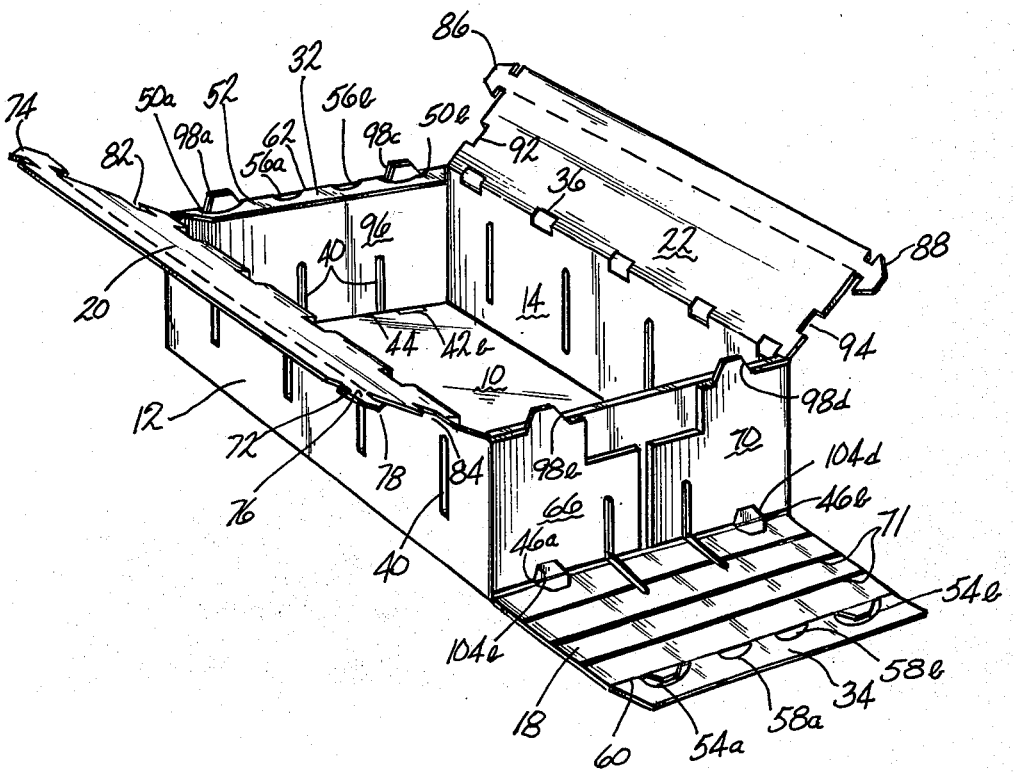
FIG. 9 is a perspective view of a carton erected from the blank of FIG. 1 and the stacking panel of FIG. 2.

FIG. 5 is a perspective view of a carton partially erected from the blank of the alternate embodiment illustrated in FIGS. 3 and 4. As can be seen in FIG. 5, when the carton is completely erected, triple-ply opposing end wall panels are formed each from an adhesively connected stacking panel 166, and at the right side of the carton, first and second side wall flaps 182, and generally rectangular end wall panel 190 and at the left side of the carton, side wall flaps 180 and end wall panel 188. Further, a double ply adhesively connected side wall assembly is formed from stacking panel flanges 168 and the respective side wall panels 172 or 174. If the respective stacking panel flanges 168 are extended on each side as shown by dashed lines 196 and 198, the entire side wall assembly assumes a double ply thickness. Without such full extensions of the stacking panel flanges 168, a double side wall thickness is provided for only the length of the stacking panel flange 168.

FIG. 6 is a plan view of a carton blank which may be used to form another embodiment of a carton having a double thickness on all four side walls. As can be seen in FIG. 6, the blank comprises a generally rectangular floor panel 200, first and second generally rectangular side wall panels 202 and 204 extending from respective fold lines 206 and 208 which define opposite side edges of said floor panel 200, first and second generally rectangular end wall panels 210 and 212 extending from opposite end edges 214 and 216 respectively, and first and second end wall flaps 218 and 220 integrally formed with and extending from opposite ends 222 and 224 respectively of said end wall panels 210 and 212. First and second generally rectangular end cover flaps 226 and 228 are integrally formed with and extend from fold lines 230 and 232 respectively defining the outer edges of said first and second end wall panels 210 and 212. Also, first and second generally rectangular side cover flaps 234 and 236 are integrally formed with and extend from fold lines 238 and 240 respectively defining the outer edges of said first and second side wall panels 202 and 204 respectively.

When utilized with the stacking panel 240 shown in FIG. 7, a generally rectangular carton may be formed as shown in the perspective view of the partially erected blank in FIG. 8.

As can be seen in FIG. 8, double-ply side walls are formed by the adhesive connection of end wall flaps 218 and side wall panel 202 and end wall flaps 220 and side wall panel 204. Further, double-ply end wall assemblies are formed by the adhesive connection of stacking panels 240 and end wall panel 212 and stacking panel 240 and end wall panel 210. If end wall flaps 218 and 220 are sufficiently long, they will cover the entire side wall panels 202 and 204 to form the double-ply thickness side wall assembly. If the end wall flap 218 and 220 are shorter than one half the length of the rectangular floor panel 200, then only a portion of the side wall assembly is of double-ply thickness. The end cover flaps 226 and 228 may be folded inwardly and side cover flaps 234 and 236 folded inwardly over the end wall flaps 226 and 228 to seal the carton.

While there has been described what is believed to be a preferred embodiment of the invention, variations and modifications therein will occur to those skilled in the art once they become acquainted with the basic concepts of the invention. Therefore, it is intended that the appended claims shall be construed to include all such variations and modifications as fall within the true spirit and scope of the invention.

What is claimed is:

1. A stackable storage and shipping tray including in combination a pair of generally rectangular shaped stacking panels wherein the completed tray includes opposed at least triple-ply adhesively connected end wall assemblies, said tray further including a generally rectangular floor panel, first and second generally rectangular side wall panels extending from fold lines defining opposite edges of said floor panel, respectively, first and second pairs of side wall flaps, each flap in each of said pairs extending from a fold line defining an end of one of said side wall panels, each of said side wall flaps including at least one tab extending upwardly from an upper edge thereof and at least one recess at its lower edge with at least a portion in vertical alignment with said tab, first and second generally rectangular end wall panels extending from opposite end edges of said floor panel, each of said end wall panels having first and second recesses at its lower edge, said floor panel end edges having openings therein, said end wall panel recesses, said floor panel end edge openings and said tabs being in vertical alignment.

2. The tray according to claim 1 which includes first and second generally rectangular side cover flaps extending from fold lines defining the upper edges of said first and second side wall panels.

3. The tray according to claim 2, which includes first and second pairs of tabs, each tab being connected to one end of one of said side cover flaps by a material bridge portion and comprising a generally tapered body having its base edge parallel to the adjacent edge of said side cover flap.

4. The tray according to claim 2 or 3, which includes first and second generally trapezoidal end cover flaps extending from fold lines at the upper edges of said first and second end wall panels, respectively, at least portions of the recesses in the side wall flaps being in vertical alignment with said end wall recesses and said floor panel edge openings.

5. A stackable storage and shipping tray having stacking panels with flanges integrally extending from opposite ends thereof which includes opposed at least triple-ply adhesively connected end wall assemblies and opposed at least double-ply adhesively connected side wall assemblies, said tray further including a generally rectangular floor panel, first and second generally rectangular side wall panels extending from fold lines defining opposite side edges of said floor panel, first and second side wall flaps integrally formed with and extending from opposite ends of said side wall panels and first and second generally rectangular end wall panels extending from opposite end edges of the floor panel, whereby each end wall panel and associated first and second side wall flaps are adhesively connected to form said at least triple-ply end wall assembly and whereby each side wall panel and associated said stacking flanges may be adhesively connected to form double-ply side wall assemblies.

6. A stackable storage and shipping tray for use in combination with generally rectangular stacking panels which includes at least double-ply end wall and side wall assemblies, said tray further including a generally rectangular floor panel, first and second generally rectangular side wall panels extending from fold lines defining opposite side edges of said floor panel, first and second generally rectangular end wall panels extending from opposite end edges of said floor panel, first and second end wall flaps, integrally formed with and extending from opposite ends of said end wall panels, and first and second generally rectangular end cover flaps integrally formed with and extending from fold lines defining upper edges of said first and second end wall panels.

7. The tray according to claim 5 which includes first and second generally rectangular side cover flaps extending from fold lines defining the upper edges of said first and second side wall panels, respectively.

8. A stackable storage and shipping tray of claim 1, including a cover panel means including recesses adjacent its end edges, each said end wall panel being adhesively connected to the outer surface of the associate side wall flaps of said side walls when said first and second recesses are aligned with a recess in the end edges of said cover panel means and first and second generally rectangular stacking panels with the outer surface of each stacking panel being adhesively connected to the inner surface of the associated side wall flaps of said side wall, and said end wall panels, side wall flaps and stacking panels forming said at least triple-ply adhesively connected end wall assemblies wherein each tab on a side wall flap extends through a recess in an end edge of said cover panel means.

9. The tray of claim 6 characterized in that trapezoidally shaped recesses are provided in said end wall panels.

10. The tray of claim 6 or 7, characterized in that said stacking panels are constructed of particle board and the remainder of said carton is constructed of paper board.

11. The tray of claim 8, characterized in that each of said stacking panels has first and second trapezoidal recesses at its lower edge which are congruent with the recesses in said end wall panels and aligned with the corresponding recesses in said side wall flaps.

12. A stackable storage and shipping tray comprising:

a. a generally rectangular floor panel, b. first and second side wall panels extending generally upright from opposite edges of said floor panel, each of said side wall panels including side wall flaps extending from opposite ends thereof and a side cover flap extending from the free side thereof, each said side cover flap including recesses adjacent its side edges, each said side wall flap including at least one tab extending upwardly from an upper edge thereof and at least one recess at its lower edge in vertical alignment with said tab, c. first and second end wall panels extending generally upright from the remaining opposite edges of said rectangular floor panel, each said end wall panel having first and second recesses at its lower edge and being adhesively connected to the outer surface of the associated side wall flaps of said side walls with said first and second recesses being aligned with the recess in each of said side wall flaps, and d. first and second generally rectangular stacking panels with the outer surface of each stacking panel being adhesively connected to the inner surface of the associated side wall flaps of said side wall, and e. said end wall panels, side wall flaps and stacking panels forming at least triple-ply adhesively connected end wall assemblies wherein each tab on a side wall flap extends through a recess in one of said side cover flaps.

* * * * *

UNITED STATES PATENT AND TRADEMARK OFFICE

CERTIFICATE OF CORRECTION

PATENT NO. : 4,347,968

DATED : September 7, 1982

INVENTOR(S) : William F. Cornell, John P. Vear, E. Anthony Pascuzzi

It is certified that error appears in the above—identified patent and that said Letters Patent is hereby corrected as shown below:

In Column 1, line 11, delete "4,175,692" and insert in lieu thereof -- 4,175,691 --.

In Column 1, line 21, delete "reaidly" and insert in lieu thereof -- readily --.

In Column 7, line 46, delete "claim 5" and insert in lieu thereof -- claim 6 --.

Signed and Sealed this

*Seventeenth* Day of *May 1983*

[SEAL]

*Attest:*

DONALD J. QUIGG

*Attesting Officer*

*Acting Commissioner of Patents and Trademarks*